US006494540B1

(12) United States Patent
Tornero

(10) Patent No.: US 6,494,540 B1
(45) Date of Patent: Dec. 17, 2002

(54) FURNITURE STRUCTURE AND METHOD

(76) Inventor: Marta V. Tornero, P.O. Box 8752, Greensboro, NC (US) 27419

( * ) Notice: Subject to any disclaimer, the term of this patent is extended or adjusted under 35 U.S.C. 154(b) by 0 days.

(21) Appl. No.: 09/881,418

(22) Filed: Jun. 14, 2001

(51) Int. Cl.[7] ..... A47C 7/02
(52) U.S. Cl. ..... 297/440.1; 297/440.11; 297/452.56
(58) Field of Search ..... 297/440.1, 440.11, 297/452.56

(56) References Cited

U.S. PATENT DOCUMENTS 1,422,915 A * 7/1922 Benson et al. ..... 297/440.11
3,289,220 A * 12/1966 Grimshaw ..... 297/452.56
3,314,200 A * 4/1967 Schuster ..... 297/440.1
3,902,756 A * 9/1975 Chubb ..... 297/452.56
3,987,534 A * 10/1976 Gold ..... 297/440.1 X
4,062,589 A * 12/1977 Klein et al. ..... 297/440.11 X
4,563,040 A * 1/1986 Alster ..... 297/440.1
4,798,414 A * 1/1989 Hughes ..... 297/440.11 X
4,869,554 A * 9/1989 Abu-Isa et al. ..... 297/452.56
5,358,309 A * 10/1994 Fedele ..... 297/440.1
5,601,339 A * 2/1997 Buinani ..... 297/440.1
5,632,526 A * 5/1997 McLarty, III et al. ... 297/452.56 X
5,653,507 A * 8/1997 Moore ..... 297/440.1
5,747,140 A * 5/1998 Heerklotz ..... 297/452.56 X
5,988,755 A * 11/1999 Fastelli et al. ..... 297/440.1 X
6,113,186 A * 9/2000 Holmes et al. ..... 297/440.11 X

* cited by examiner

*Primary Examiner*—Peter M. Cuomo
*Assistant Examiner*—Rodney B. White

(57) ABSTRACT

A furniture structure and method are provided for chairs or other furniture as used in offices and homes. The structure provides an improved method of assembly using stretchable fabric spaced between opposing side frame members. Inserts attached to the fabric are used to selectively draw the fabric towards the side frames with threaded members so that a desirable tension can be applied to the fabric for comfort and aesthetic purposes. When worn the fabric can be easily replaced in the field by unskilled consumers.

19 Claims, 6 Drawing Sheets

FURNITURE STRUCTURE AND METHOD

FIELD OF THE INVENTION

The invention herein pertains to furniture as used in homes and offices and particularly pertains to furniture and manufacturing methods for chairs and the like utilizing stretchable fabrics for the seat and back which do not require springs or webbing suspensions.

DESCRIPTION OF THE PRIOR ART AND OBJECTIVES OF THE INVENTION

With recent increased labor and equipment costs in the furniture industry manufacturers and distributors have often searched foreign markets for less expensive products to import and techniques to reduce their manufacturing costs. While chairs used for offices, professional waiting rooms and homes are generally mass produced and are generally not field replaceable, such require extensive skilled labor, particularly if upholstering steps are needed. Hence, there has been a long felt need for such furniture which is relatively inexpensive to manufacture yet which provides the comfort and styling of higher priced conventional upholstered furniture. With the disadvantages and costs of current furniture manufacturing methods, the present invention was conceived and one of its objectives is to provide furniture structures such as chairs with relatively simple, inexpensive constructions that are aesthetically pleasing and are comfortable to use.

It is another objective of the present invention to provide a furniture structure such as a chair with a stretchable fabric assembly in place of more laborious upholstering and padding techniques.

It is still another objective of the present invention to provide a furniture structure in which a stretchable fabric seat is positioned between opposing side frame members whereby the seat fabric can be selectively drawn to obtain a suitable, comfortable tension.

It is yet another objective of the present invention to provide a method of constructing furniture utilizing fabric which is secured between opposing sides tensioned with threaded members.

It is a further objective of the present invention to provide a method of chair construction in which the back and seat utilize stretchable fabrics.

Another objective of the present invention to provide a method of furniture assembly utilizing conventional woods, plastics and metal materials.

Still another objective of the present invention is to provide a method for chair construction which allows for field replacement of the seat and back fabric components.

It is also an objective of the present invention to provide a method of furniture construction in which relatively unskilled workers can easily learn the assembly processes.

Various other objectives and advantages of the present invention will become apparent to those skilled in the art as a more detailed description is set forth below.

SUMMARY OF THE INVENTION

In the preferred embodiment of the invention, a chair is provided which includes a pair of opposing wooden side frame members which are grooved to accept a seat and back. The seat and back are formed by utilizing wooden inserts which are fabric covered and stapled. The inserts are then adjustably attached to opposing side frame members and selectively tensioned using threaded members. The side frame members are grooved to accept the insert as the fabric is stretched during the final tightening of the threaded members. Field replacement of the back and seat are relatively easy and can be accomplished by unskilled persons. A commercially available stretchable fabric such as Collage™ (as manufactured by Matrex, Inc., 911 Northridge Street, Greensboro, N.C. 27403) is utilized. This fabric has elastomeric monofilaments sufficient to provide load bearing properties. When the fabric is tensioned the resilient qualities allow full recovery when the load is removed.

In an alternate embodiment of the invention a desk chair is shown and described having a plurality of rollers. The desk chair is manufactured using metal braces and metal side frame members in the back and seat. Once the seat and back fabrics have been tightened sufficiently, caps are positioned over the sides of the back and seat to enclose the metal frame members which make the chair more aesthetically pleasing.

DETAILED DESCRIPTION OF THE PREFERRED EMBODIMENTS AND OPERATION OF THE INVENTION

Figure 1:
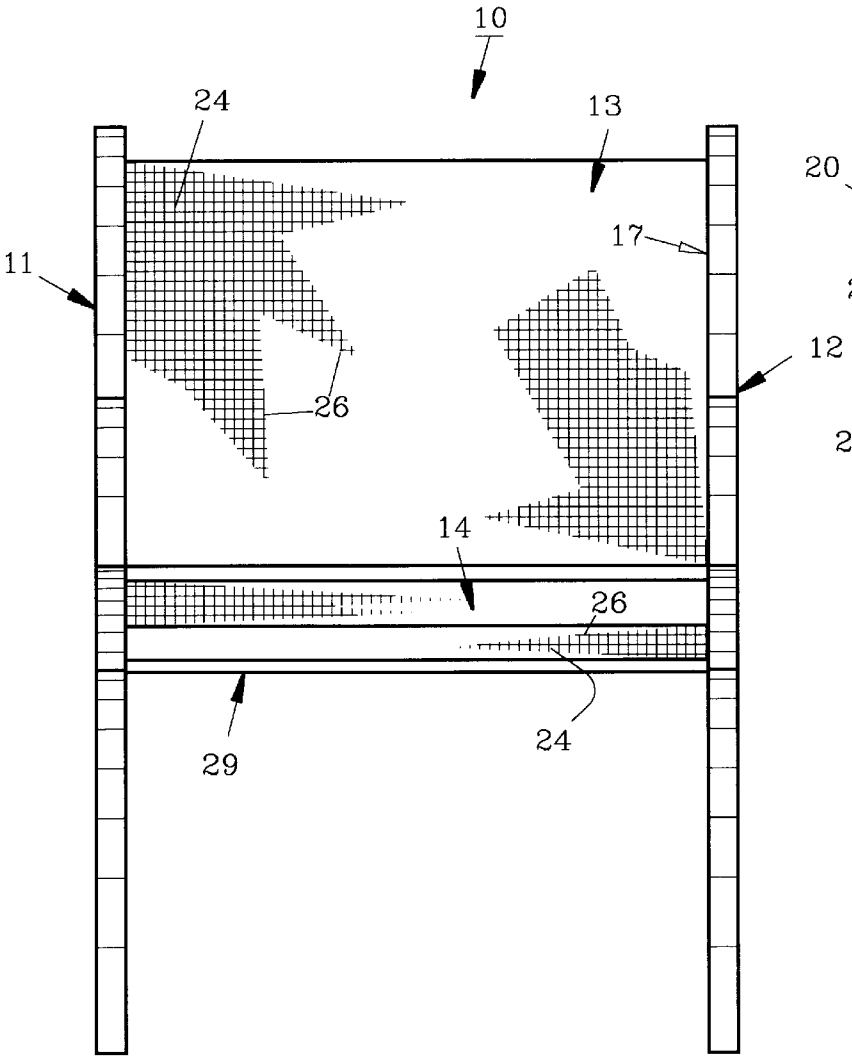
FIG. 1 shows the preferred embodiment of the invention as a front view of a chair.

For a better understanding of the invention and its operation, turning now to the drawings, the preferred form of the furniture structure described herein is illustrated in FIGS. 1–7 wherein chair 10 as shown in FIG. 1 includes left side frame member 11 and opposing right side frame member 12 formed from preferably high quality plywood although other woods, molded plastics or the like could be utilized. Chair 10 includes back 13 and seat 14. Chair 10 could be used for example as a reception room chair, office chair or otherwise and the structure shown could also apply to tandem seating where chairs are joined using a common arm. The backs and seats can be easily replaced by customers or others with little furniture construction skills.

Figure 3:
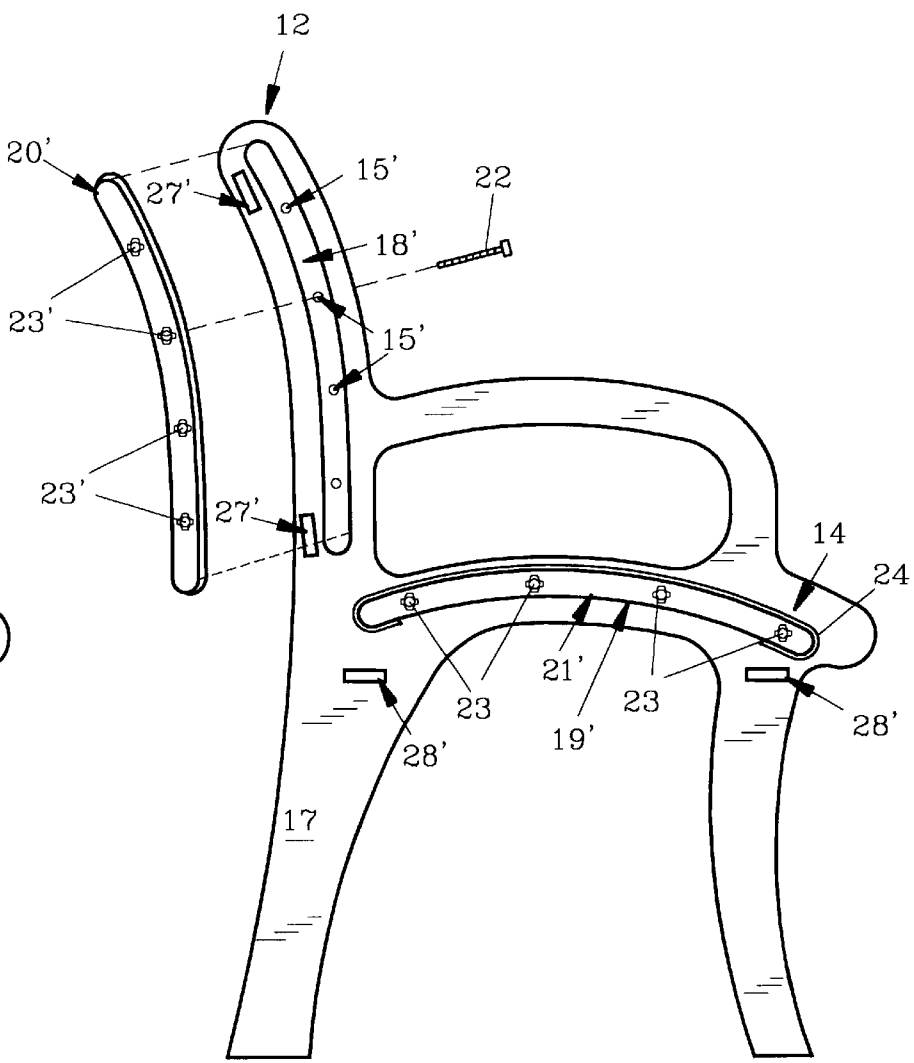
FIG. 3 depicts a view of the inside right side of the chair seen in FIG. 1 with the back insert exploded therefrom.
Figure 2:
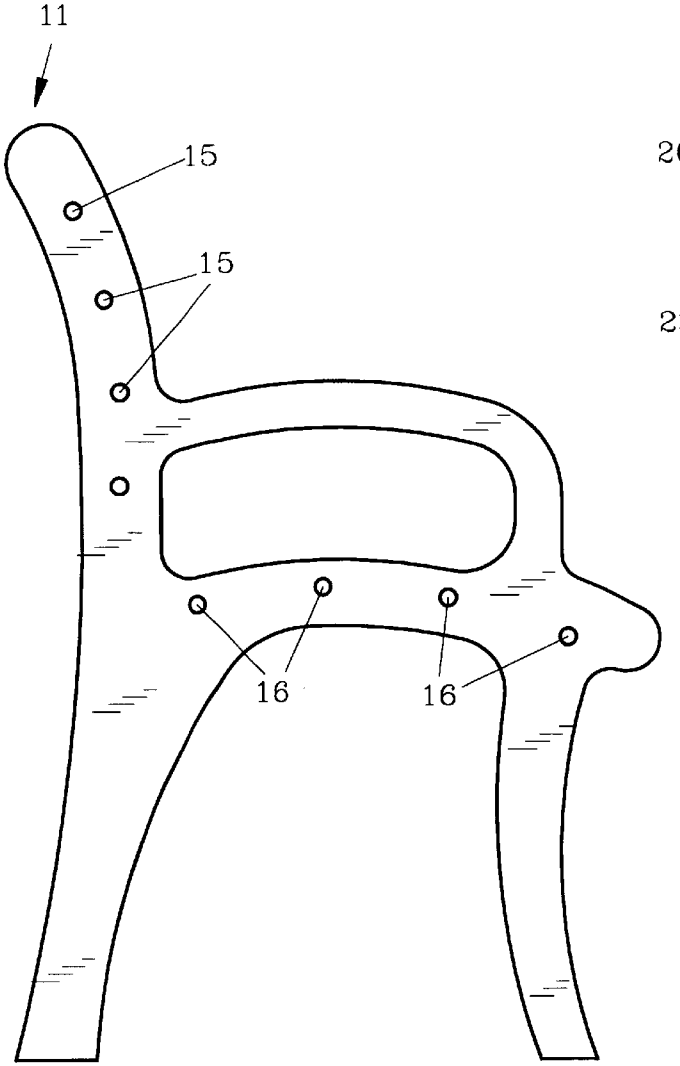
FIG. 2 demonstrates a view of the left side frame member of the chair as shown in FIG. 1.

As seen FIGS. 2 and 3 chair left side frame member 11 and right side frame member 12 are cut from a single sheet of high quality plywood and include apertures 15, 15' respectively for inserting threaded members therethrough to hold and tension back 13. Apertures 16, 16' (not shown) allow insertion of threaded members therethrough to maintain and tension seat 14. Right side frame member 12 in FIG. 3 illustrates inner surface 17 as depicted in FIG. 1 and includes routed groove 18' for supporting back 13 (seen removed in FIG. 4) and groove 19' for supporting seat 14. As further shown in FIG. 3, back insert 20' is preferably formed from wood such as maple or otherwise and is configured to fit within groove 18'. Threaded member 22 also shown in FIG. 3 is seen exploded from aperture 15'. As would be understood, before such threaded members 22 pass through apertures 15', threaded fasteners 23' are lodged in preformed apertures of insert 20' to receive and engage threaded members 22. Seat 14 as shown in FIG. 3 includes insert 21' which is also preferably formed from wood such as maple. Insert 21' is shown covered with fabric 24 as is chair back 13 shown in FIG. 4. Threaded fasteners 23 commonly known as "tee-nuts" engage threaded members 22 which pass through apertures 16 of left side frame member 11 to retain seat 14 in place. As would be further understood, left side frame member 11 of chair 10 and right side frame member 12 are mirror images and only one surface of each are shown herein for expediency purposes. Fabric 24 on seat 14 is attached to insert 21' with some excess fabric being wrapped around the ends of insert 21', but does not completely cover the bottom of insert 21'. Back 13 however is preferably, completely covered with fabric along the entire front and back of inserts 20, 20'(FIG. 4) for aesthetic purposes. Routed lateral rail slots 27', 28' are also shown in FIG. 3 on side frame member 12 which receive wooden rails 29 which are preferably affixed by adhesives to provide additional support to chair 10. Corresponding routed rail slots 27, 28 on side frame member 11 are not shown. Rails 29 are placed in lateral rail slots 27', 28'(only one rail 29 is shown in FIG. 1).

Figure 4:
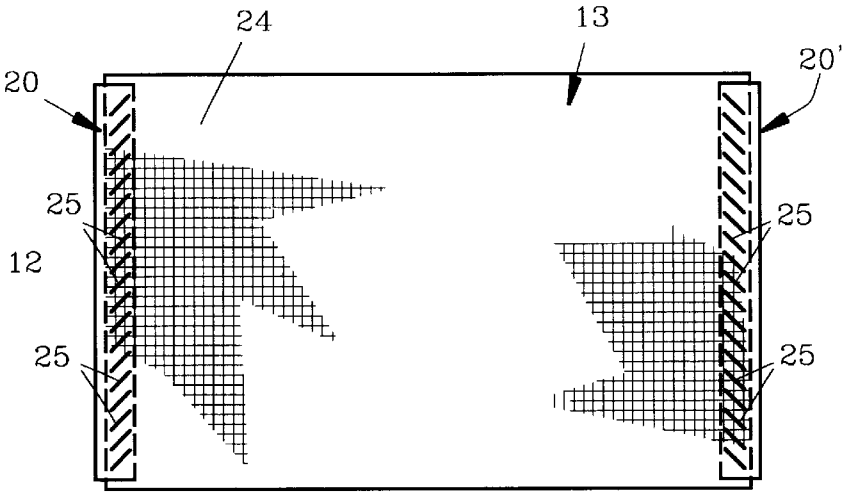
FIG. 4 pictures a front view of the back of the chair as shown in FIG. 1 removed from the opposing side frame members.

Preferred stretchable fabric 24 consists of elastomeric polyester fabric M-029/1 as sold by Matrex, Inc. of Greensboro, N.C. under the name Collage™, and is affixed to back inserts 20, 20' as shown in FIG. 4 by staples 25 as are conventionally, preferably used in furniture upholstering. Fabric 24 includes elastic monofilaments 26 as seen in FIG. 1. Other fasteners such as tacks, RF welding, adhesives or the like could likewise be used but are not preferred. Also the fabric selected can be integrally attached to the inserts during injection molding of the inserts, if desired.

Figure 7:
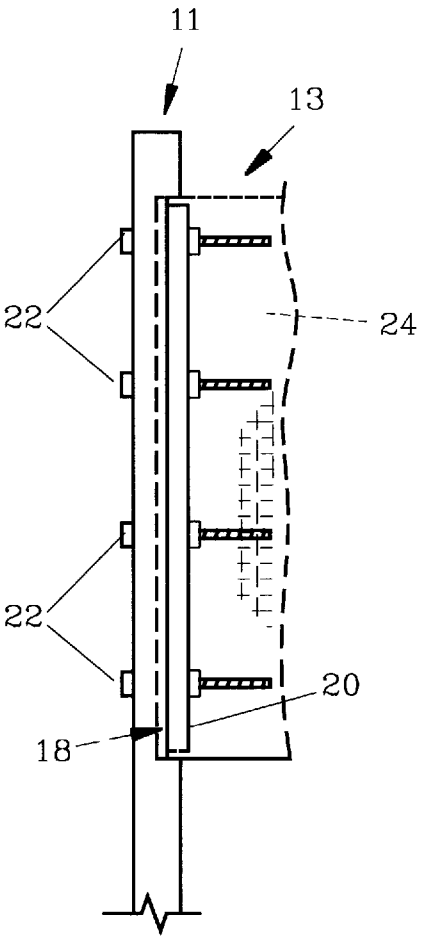
FIG. 7 illustrates the chair back of FIG. 6 in a more tensioned position within the left side frame member.
Figure 6:
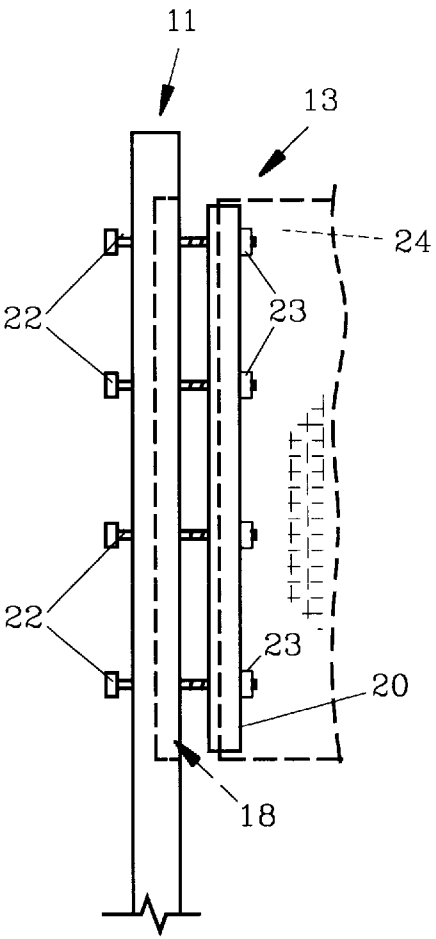
FIG. 6 features a further assembly step with the back initially secured to the left side frame member.
Figure 5:
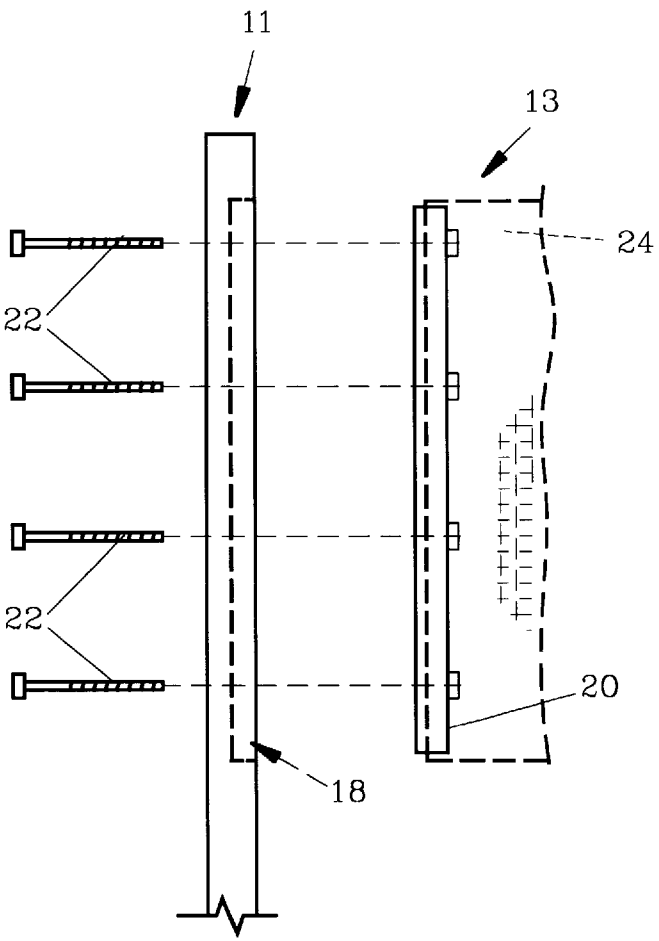
FIG. 5 shows in schematic representation the initial step in the assembly of the chair back as shown in FIG. 1.
Figure 8:
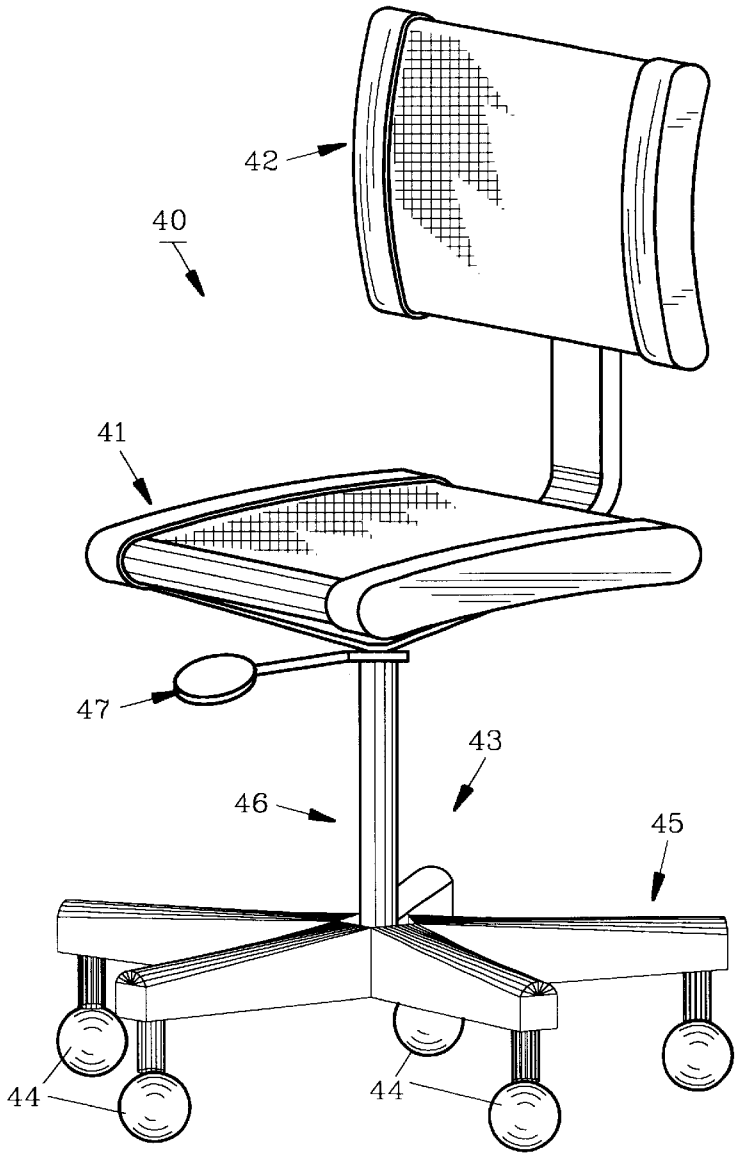
FIG. 8 demonstrates an alternate embodiment of the invention as a typical office desk chair.

The preferred method of assembling chair 10 as seen in FIG. 1 is described as follows: First, inserts 20, 20' as shown in FIG. 4 are placed on a worktable or the like and a suitable stretchable fabric 24 is selected and cut to size. Next, the edges of fabric 24 are then stapled to inserts 20, 20' both on the front and back, completely around inserts 20, 20' to retain fabric 24 thereon. As fabric 24 is somewhat stretchable, fabric 24 is cut slightly less in width than the width between sides 11, 12 when chair 10 is assembled so fabric 24 can be stretched or tensioned to a taut posture. Seat 14 is then assembled in the same manner. In FIG. 5, back 13 is illustrated in fragmented fashion with fabric 24 seen in ghost fashion, as back 13 is brought into position proximate left side frame member 11. In FIG. 6, back 13 is initially joined to left side frame member 11 by threaded members 22. Next, insert 20'(not shown in FIG. 6) is likewise affixed to right side frame member 12 of chair 10. Threaded members 22 engage threaded fasteners 23 affixed to each side frame member (11, 12). Seat 14 likewise has inserts 21, 21' covered with fabric 24 by stapling and has apertures with fasteners 23 affixed as seen in FIG. 3. Seat 14 is then initially affixed to left side frame member 11 and right side frame member 12 of chair 10 as illustrated in FIG. 6 (showing back 13). Upon initial fastening of back 13 and seat 14 to side frame members 11 and 12, lateral rails 29 are inserted in preformed slots 27, 28 (not seen) and 27' and 28' of respectively left side frame member 11 and right side frame member 12 and are glued for stability purposes. Next, threaded fasteners 22 along both the left and right side frame members (11, 12) of chair 10 are further tightened to draw for example insert 20 as shown in FIG. 7 further into routed groove 18 of right side frame member 11. Insert 20' is likewise drawn into groove 18' of left side frame member 12 whereby fabric 24 will be suitably tightened for back 14. Similarly, fabric 24 will be tightened in the same manner along both sides of chair 10 seat 14 to provide a comfortable, firm seat. As necessary, back 13 and seat 14 can be additionally tightened for maintenance and/or repair purposes. While four threaded members 22 are shown in FIGS. 5–7 for back 13 and seat 14 on each side of chair 10, more or less threaded members 22 could be utilized as needed.

Figure 10:
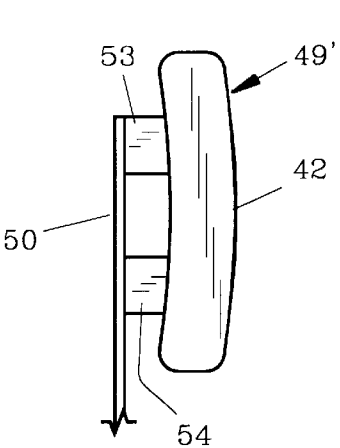
FIG. 10 shows a side view of the back of the chair in FIG. 9 along in 10—10.
Figure 9:
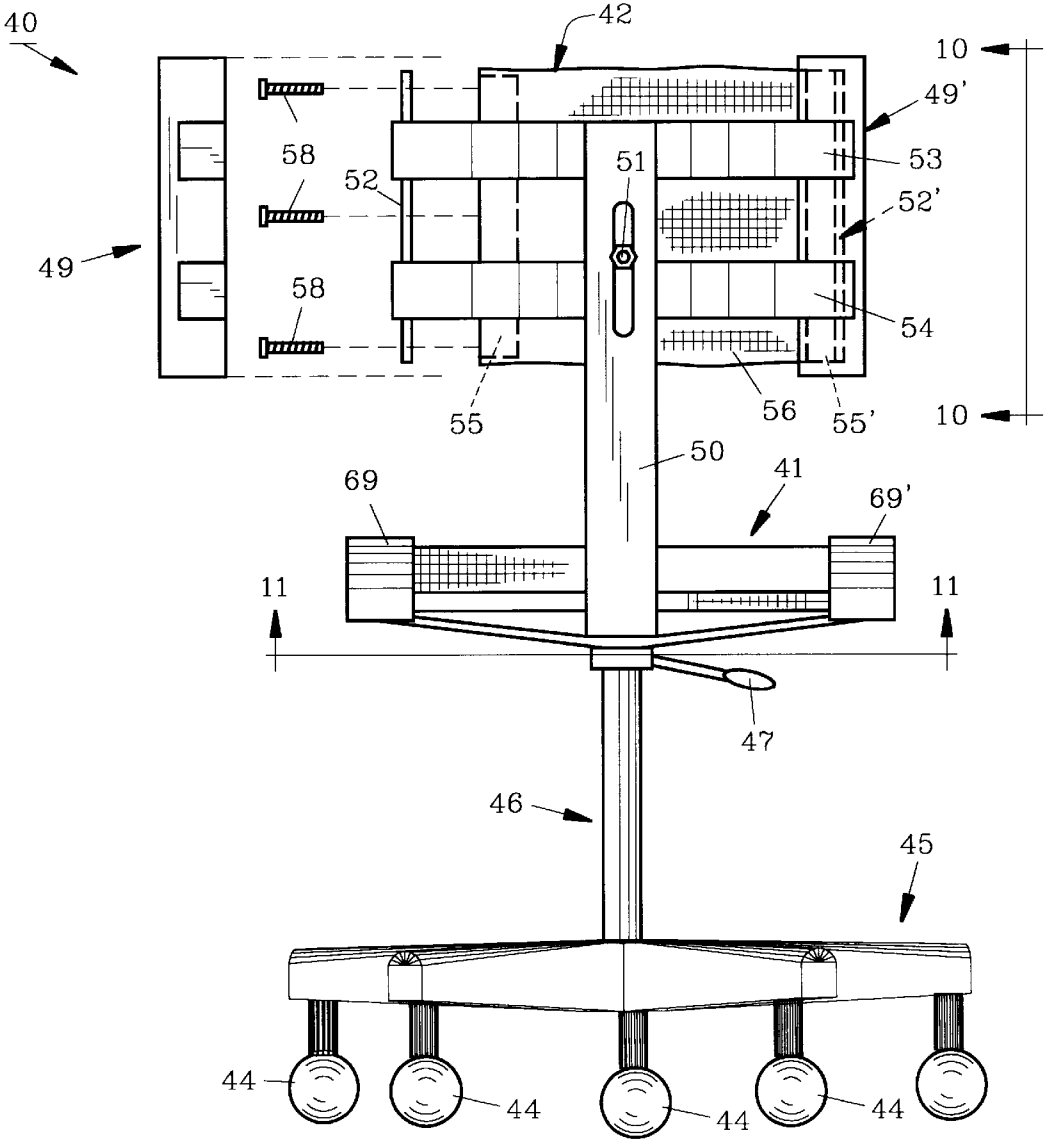
FIG. 9 pictures a rear view of the chair as shown in FIG. 8 with one of the back caps removed therefrom.

An alternate embodiment of the invention is shown in FIGS. 8–11 with desk chair 40 shown having a seat 41 and back 42 affixed to chair base 43. Chair base 43 includes a series of conventional rollers 44 attached to base frame 45. Vertical extension 46 is joined to base frame 45 and includes standard seat lever 47 which allows adjustment of seat 41 as is typical. In FIG. 9 a rear view of chair 40 is seen whereby caps 49, 49' which may be molded from wood or plastic as hereinbefore described cover metal side frame members 52, 52'. As also shown, back 42 is attached to stanchion 50 and is vertically adjustable with threaded fastener 51, also conventional. Back 42 includes left side frame member 52 and right side frame member 52' which are permanently affixed such as by welding or bolting to metal back brace members 53, 54. In FIG. 10 braces 53, 54 are seen as they support back 42 in spacial relation from stanchion 50. Insert 55, 55' which are formed preferably from wood, are attached to fabric 56 which extends between left insert 55 and right insert 55' as seen in FIG. 9. Thus, inserts 55, 55' with fabric 56 attached as by stapling are initially attached to metal side members 52, 52' respectively with threaded members 58 and are then adjustably tightened into threaded fasteners 59 (not seen on inserts 55, 55') to selectively stretch fabric 56 as hereinbefore described regarding chair 10, to achieve the desired fabric tension and comfort for back 42. Once threaded members 58 are sufficiently tightened with back 42 in place on stanchion 50, caps 49, 49' which may be formed from wood but preferably made of molded plastic are inserted over, respectively side frame members 52, 52' to provide chair 40 with a finished aesthetically pleasing appearance.

Figure 11:
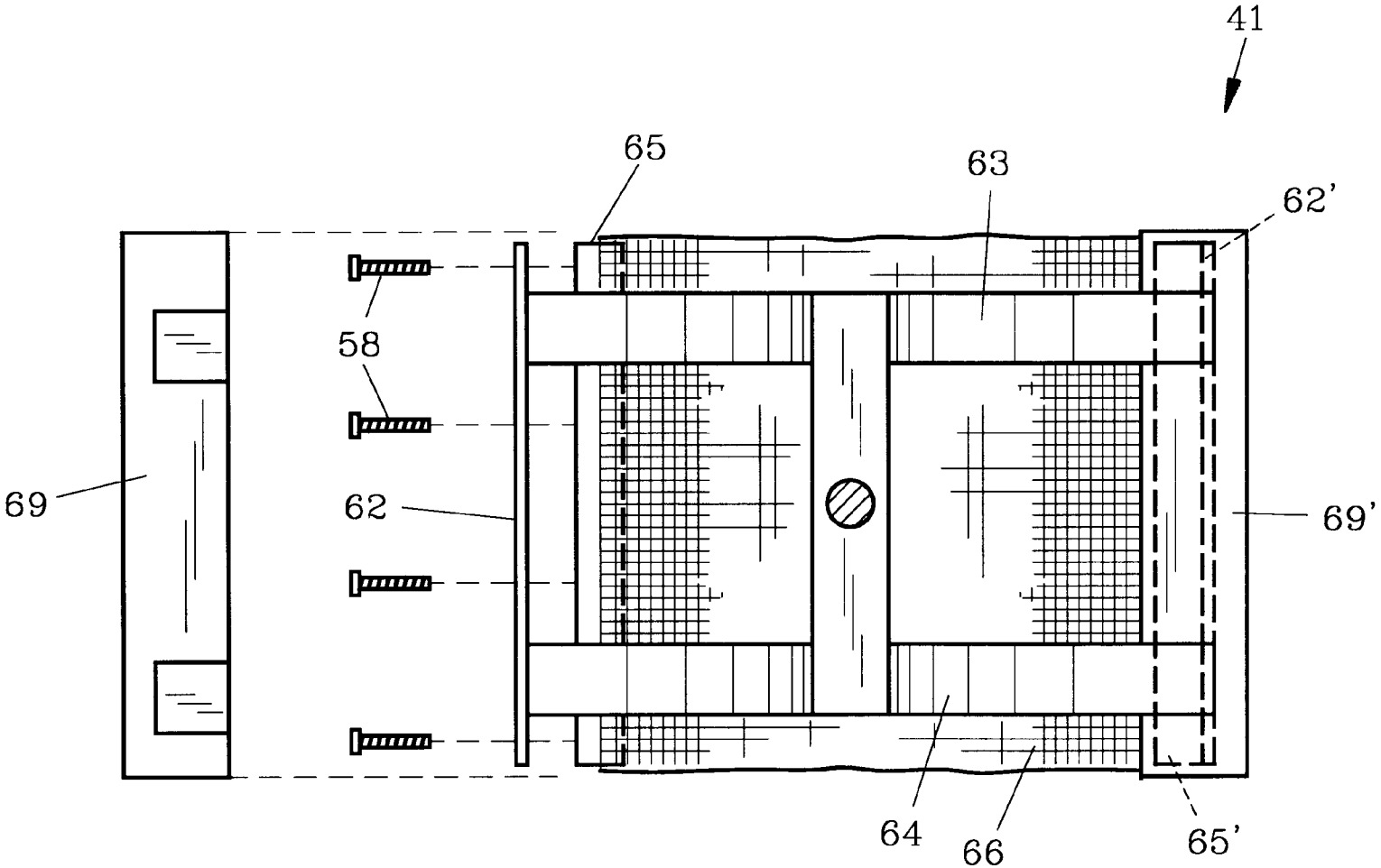
FIG. 11 illustrates a bottom view of the chair seat as shown along lines 11—11 of FIG. 9 with a side cap exploded therefrom to better illustrate the seat construction.

Chair seat 41 in FIG. 11 is shown from underneath and is assembled in the same way as chair back 42. Metal side frame members 62, 62' are rigidly affixed to brace members 63, 64 such as by welding or bolting. Seat fabric 66 is affixed with staples or the like to frame insert members 65, 65' and threaded members 58 are then used to draw frame member inserts 65, 65' towards side frame members 62, 62' respectively as hereinbefore described until the desired seat fabric tightness or tension is achieved. Thereafter, molded side cap 69, 69' are then placed over the side members to for aesthetic purposes.

The illustrations and examples provided herein are for explanatory purposes and are not intended to limit the scope of the appended claims.

I claim:

1. A method of constructing furniture which accommodates field replacement, said furniture including fabric and a frame having opposing left and right side frame members and left and right frame inserts, said side frame members each receiving an insert which is fabric covered, the method comprising the steps of:

a) selecting a furniture fabric;

b) attaching the fabric to the frame inserts to enclose the ends of the inserts;

c) extending the fabric between the opposing side frame members;

d) initially securing the inserts to each of said side frame members; and e) drawing the fabric enclosed inserts to said side frame members to tighten the fabric between the side frame members.

2. The method of claim 1 wherein selecting a furniture fabric comprises the step of selecting a stretchable, load-bearing fabric.

3. The method of claim 2 wherein selecting a furniture fabric comprises selecting a fabric having elastomeric monofilaments.

4. The method of claim 1 wherein initially securing the inserts to the side frame members comprises the step of securing the inserts with threaded members.

5. The method of claim 4 wherein drawing the inserts comprise the step of drawing the inserts towards the side frame members by rotating the threaded members.

6. The method of claim 1 further comprising the step of placing a cap over a side member.

7. The method of claim 1 wherein extending the fabric between the side frame members includes the step of initially attaching the fabric to the opposing left and right side frame members with staples.

8. The method of claim 1 wherein selecting a fabric comprises the step of selecting an elastomeric fabric.

9. The method of claim 1 wherein extending the fabric comprises the step of extending a seating fabric having elastomeric monofilaments between said opposing inserts.

10. A furniture structure comprising a pair of opposing left and right side frame members, said frame members each defining a contoured groove, each of said grooves having a length and a width, a fabric sheet, said fabric sheet extending between said frame members, a left frame insert, said left frame insert attached to said fabric along one edge thereof said fabric enclosing the ends of said insert, said left frame insert contoured and sized to fit widthwise and lengthwise while covered with said fabric within said left side frame groove, said left insert adjustably attached to said left side frame member whereby said left frame insert can be selectively drawn towards said left side frame member to tension said fabric while said insert is drawn into said groove.

11. The furniture structure of claim 10 comprising a chair seat.

12. The furniture structure of claim 10 comprising a chair back.

13. The furniture structure of claim 10 wherein said fabric sheet is stretchable.

14. The furniture structure of claim 10 wherein said left frame insert is attached to said fabric with staples.

15. The furniture structure of claim 10 wherein said left frame insert is attached to said fabric with an adhesive.

16. The furniture structure of claim 10 wherein said left frame insert is attached to said fabric by RF welding.

17. The furniture structure of claim 10 wherein said left frame insert is attached to said fabric during molding.

18. The furniture structure of claim 10 further comprising a right frame insert, said right frame insert attached to said fabric along an edge in opposing relation to said left frame insert.

19. The furniture structure of claim 10 further comprising a threaded member, said threaded member received by said left insert for drawing said left insert towards said left side frame member.

* * * * *